US008157634B2

(12) United States Patent
Englman et al.

(10) Patent No.: US 8,157,634 B2
(45) Date of Patent: Apr. 17, 2012

(54) WAGERING GAME WITH PYRAMIDAL BONUS SELECTION FEATURE

(75) Inventors: Allon G. Englman, Chicago, IL (US); Jeremy M. Hornik, Chicago, IL (US); Joel R. Jaffe, Glenview, IL (US)

(73) Assignee: WMS Gaming Inc., Waukegan, IL (US)

( * ) Notice: Subject to any disclaimer, the term of this patent is extended or adjusted under 35 U.S.C. 154(b) by 815 days.

(21) Appl. No.: 12/302,000

(22) PCT Filed: May 22, 2007

(86) PCT No.: PCT/US2007/012148

§ 371 (c)(1),
(2), (4) Date: Nov. 21, 2008

(87) PCT Pub. No.: WO2007/139774

PCT Pub. Date: Dec. 6, 2007

(65) Prior Publication Data

US 2010/0248806 A1 Sep. 30, 2010

Related U.S. Application Data

(60) Provisional application No. 60/802,638, filed on May 23, 2006.

(51) Int. Cl.
*A63F 9/24* (2006.01)

(52) U.S. Cl. ..... 463/16; 463/20

(58) Field of Classification Search ..... 463/16–20, 463/25–42; 273/138 R, 292
See application file for complete search history.

(56) References Cited

U.S. PATENT DOCUMENTS

| | | | | |
|---|---|---|---|---|
| 7,175,523 | B2 * | 2/2007 | Gilmore et al. | 463/16 |
| 2003/0130025 | A1 * | 7/2003 | Gilmore et al. | 463/16 |
| 2005/0215311 | A1 * | 9/2005 | Hornik et al. | 463/20 |
| 2005/0288093 | A1 * | 12/2005 | Englman et al. | 463/20 |
| 2006/0068874 | A1 * | 3/2006 | Hornik et al. | 463/16 |
| 2006/0068893 | A1 * | 3/2006 | Jaffe et al. | 463/20 |
| 2007/0149267 | A1 * | 6/2007 | Ross et al. | 463/13 |

OTHER PUBLICATIONS

International Search Report—PCT/US2007/012148 mailed Aug. 8, 2008 (2 pages).
International Written Opinion—PCT/US2007/012148 mailed Aug. 8, 2008 (3 pages).

* cited by examiner

*Primary Examiner* — Masud Ahmed
(74) *Attorney, Agent, or Firm* — Nixon Peabody LLP

(57) ABSTRACT

A gaming machine for conducting a wagering game includes at least one display and a controller coupled to the display. The display is adapted to display a randomly selected outcome of a basic game of the wagering game. The display displays at least one free spin of a plurality of reels to indicate a free-spin outcome in response to satisfaction of a free-spin event condition in the basic game. At least one possible free-spin outcome is a special-event outcome for permitting play of the special-event. The special-event includes a plurality of levels. Each level has player-selectable elements masking awards including a level-advance outcome. The level-advance outcome allows the player to advance to a next level in the special-event.

20 Claims, 9 Drawing Sheets

WAGERING GAME WITH PYRAMIDAL BONUS SELECTION FEATURE

CROSS-REFERENCE TO RELATED APPLICATIONS

This application is a U.S. national stage of International Application No. PCT/US2007/012148, filed May 22, 2007, which is related to and claims the benefit of U.S. Provisional Application No. 60/802,638, filed May 23, 2006, each of which is hereby incorporated by reference herein in its entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming machines, and methods for playing wagering games, and more particularly, to a gaming machine including a basic game with bonus rounds achievable therein.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

One concept that has been successfully employed to enhance the entertainment value of a game is the concept of a "secondary" or "bonus" game that may be played in conjunction with a "basic" game. The bonus game may comprise any type of game, either similar to or completely different from the basic game, which is entered upon the occurrence of a selected event or outcome in the basic game. Generally, bonus games provide a greater expectation of winning than the basic game and may also be accompanied with more attractive or unusual video displays and/or audio. Because the bonus game concept offers tremendous advantages in player appeal and excitement relative to other known games, and because such games are attractive to both players and operators, there is a continuing need to develop gaming machines with new types of bonus games to satisfy the demands of players and operators.

SUMMARY OF THE INVENTION

According to one aspect of the present invention, a gaming machine for conducting a wagering game includes at least one display and a controller coupled to the display. The display is adapted to display a randomly selected outcome of a basic game of the wagering game. The display displays at least one free spin of a plurality of reels to indicate a free-spin outcome in response to satisfaction of a free-spin event condition in the basic game. At least one possible free-spin outcome is a special-event outcome for permitting play of a special-event. The special-event includes a plurality of levels. Each level has player-selectable elements masking awards including a level-advance outcome. The level-advance outcome allows the player to advance to a next level in the special-event.

According to another aspect of the invention, a method of conducting a wagering game on a gaming machine includes initiating a basic game of the wagering game. The wagering game also includes a free-spin event and a special-event. The basic game includes at least one free-spin event outcome. The method further includes the act of initiating the free-spin event in response to achieving the free-spin event outcome in the basic game. The free-spin event includes at least one special-event outcome. The method further includes the act of initiating the special-event in response to achieving the at least one special-event outcome during the free-spin event. The special-event has a plurality of player-selectable elements that mask awards. The method further includes receiving a selection of at least one player-selectable element included in one of the plurality of levels. After receiving the selection, the method additionally includes the act of storing a special-event game state for later use in the free-spin event.

According to yet another aspect of the invention, a method of conducting a wagering game on a gaming machine comprises initiating a basic game of the wagering game. The wagering game further includes a free-spin event and a special-event. The basic game includes at least one free-spin event outcome. The method also includes the act of initiating the free-spin event in response to achieving a free-spin event outcome wherein the free-spin event includes at least one special-event outcome. The method additionally includes the act of achieving the special-event outcome during the free-spin event. The special-event is repeatedly achievable during the free-spin event. The method further includes initiating the special-event once the special-event outcome is achieved, wherein the state of the special-event is saved upon return to the free-spin event.

According to yet another aspect of the invention, a computer readable storage medium is encoded with instructions for directing a gaming system to perform the above-described methods.

Additional aspects of the invention will be apparent to those of ordinary skill in the art in view of the detailed description of various embodiments, which is made with reference to the drawings, a brief description of which is provided below.

DETAILED DESCRIPTION

Figure 1A:
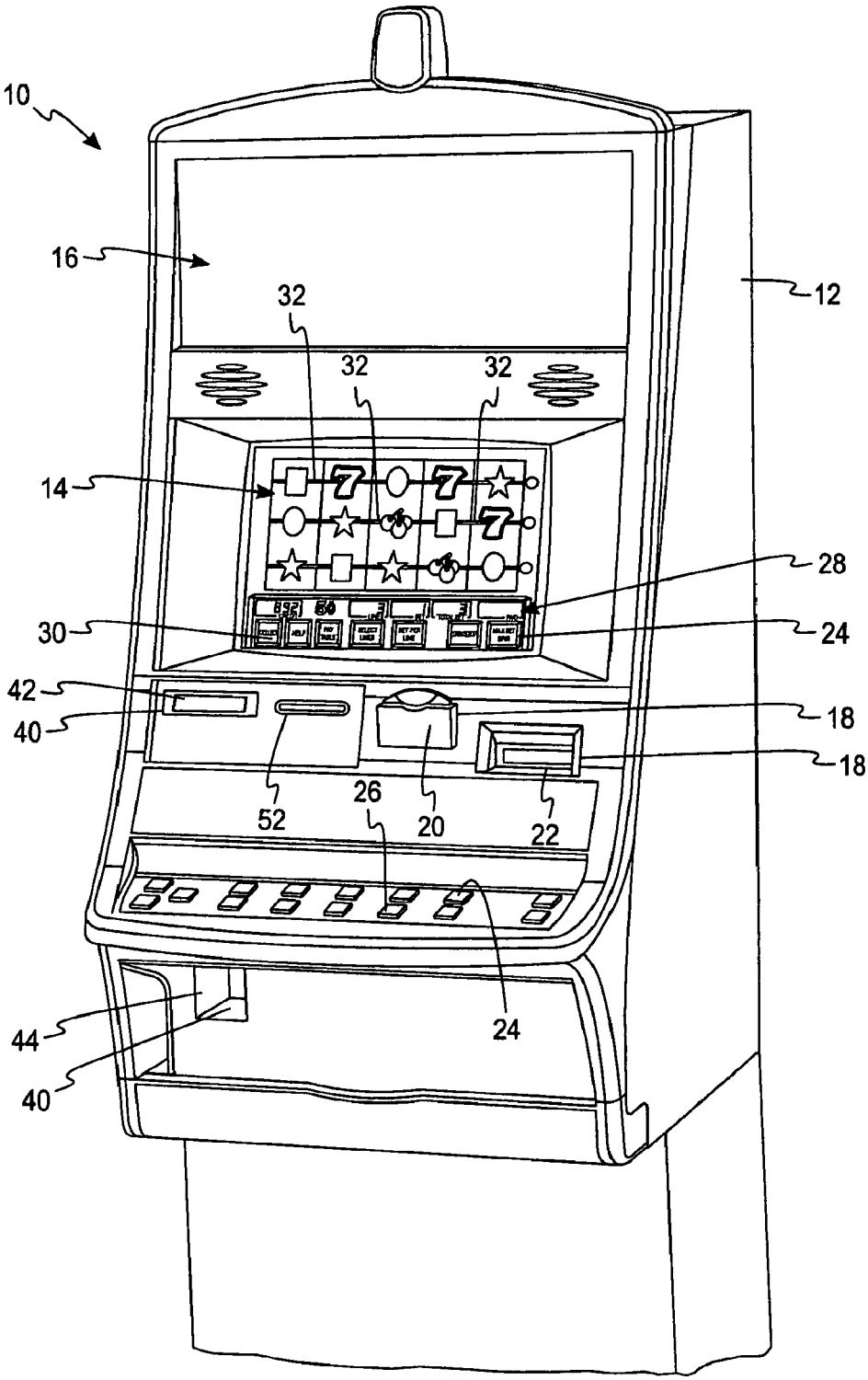
FIG. 1*a* is a perspective view of a gaming machine embodying the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to FIG. 1*a*, a gaming machine 10 is used in gaming establishments such as casinos. With regard to the present invention, the gaming machine 10 may be any type of gaming machine and may have varying structures and methods of operation. For example, the gaming machine 10 may be an electromechanical gaming machine configured to play mechanical slots, or it may be an electronic gaming machine configured to play a video casino game, such as blackjack, slots, keno, poker, blackjack, roulette, etc.

The gaming machine 10 comprises a housing 12 and includes input devices, including a value input device 18 and a player input device 24. For output the gaming machine 10 includes a primary display 14 for displaying information about the basic wagering game. The primary display 14 can also display information about a bonus wagering game and a progressive wagering game. The gaming machine 10 may also include a secondary display 16 for displaying game events, game outcomes, and/or signage information. While these typical components found in the gaming machine 10 are described below, it should be understood that numerous other elements may exist and may be used in any number of combinations to create various forms of a gaming machine 10.

The value input device 18 may be provided in many forms, individually or in combination, and is preferably located on the front of the housing 12. The value input device 18 receives currency and/or credits that are inserted by a player. The value input device 18 may include a coin acceptor 20 for receiving coin currency (see FIG. 1*a*). Alternatively, or in addition, the value input device 18 may include a bill acceptor 22 for receiving paper currency. Furthermore, the value input device 18 may include a ticket reader, or barcode scanner, for reading information stored on a credit ticket, a card, or other tangible portable credit storage device. The credit ticket or card may also authorize access to a central account, which can transfer money to the gaming machine 10.

The player input device 24 comprises a plurality of push buttons 26 on a button panel for operating the gaming machine 10. In addition, or alternatively, the player input device 24 may comprise a touch screen 28 mounted by adhesive, tape, or the like over the primary display 14 and/or secondary display 16. The touch screen 28 contains soft touch keys 30 denoted by graphics on the underlying primary display 14 and used to operate the gaming machine 10. The touch screen 28 provides players with an alternative method of input. A player enables a desired function either by touching the touch screen 28 at an appropriate touch key 30 or by pressing an appropriate push button 26 on the button panel. The touch keys 30 may be used to implement the same functions as push buttons 26. Alternatively, the push buttons 26 may provide inputs for one aspect of the operating the game, while the touch keys 30 may allow for input needed for another aspect of the game.

The various components of the gaming machine 10 may be connected directly to, or contained within, the housing 12, as seen in FIG. 1*a*, or may be located outboard of the housing 12 and connected to the housing 12 via a variety of different wired or wireless connection methods. Thus, the gaming machine 10 comprises these components whether housed in the housing 12, or outboard of the housing 12 and connected remotely.

The operation of the basic wagering game is displayed to the player on the primary display 14. The primary display 14 can also display the bonus game associated with the basic wagering game. The primary display 14 may take the form of a cathode ray tube (CRT), a high resolution LCD, a plasma display, an LED, or any other type of display suitable for use in the gaming machine 10. As shown, the primary display 14 includes the touch screen 28 overlaying the entire monitor (or a portion thereof) to allow players to make game-related selections. Alternatively, the primary display 14 of the gaming machine 10 may include a number of mechanical reels to display the outcome in visual associated to at least one payline 32. In the illustrated embodiment, the gaming machine 10 is an "upright" version in which the primary display 14 is oriented vertically relative to the player. Alternatively, the gaming machine may be a "slant-top" version in which the primary display 14 is slanted at about a thirty-degree angle toward the player of the gaming machine 10.

A player begins play of the basic wagering game by making a wager via the value input device 18 of the gaming machine 10. A player can select play by using the player input device 24, via the buttons 26 or the touch screen keys 30. The basic game consists of a plurality of symbols arranged in an array, and includes at least one payline 32 that indicates one or more outcomes of the basic game. Such outcomes are randomly selected in response to the wagering input by the player. At least one of the plurality of randomly-selected outcomes may be a start-bonus outcome, which can include any variations of symbols or symbol combinations triggering a bonus game.

In some embodiments, the gaming machine 10 may also include a player information reader 52 that allows for identification of a player by reading a card with information indicating his or her true identity. The player information reader 52 is shown in FIG. 1*a* as a card reader, but may take on many forms including a ticket reader, bar code scanner, RFID transceiver or computer readable storage medium interface. Currently, identification is generally used by casinos for rewarding certain players with complimentary services or special offers. For example, a player may be enrolled in the gaming establishment's loyalty club and may be awarded certain complimentary services as that player collects points in his or her player-tracking account. The player inserts his or her card into the player information reader 52, which allows the casino's computers to register that player's wagering at the gaming machine 10. The gaming machine 10 may use the secondary display 16 or other dedicated player-tracking display for providing the player with information about his or her account or other player-specific information. Also, in some embodiments, the information reader 52 may be used to restore game assets that the player achieved and saved during a previous game session.

Figure 1B:
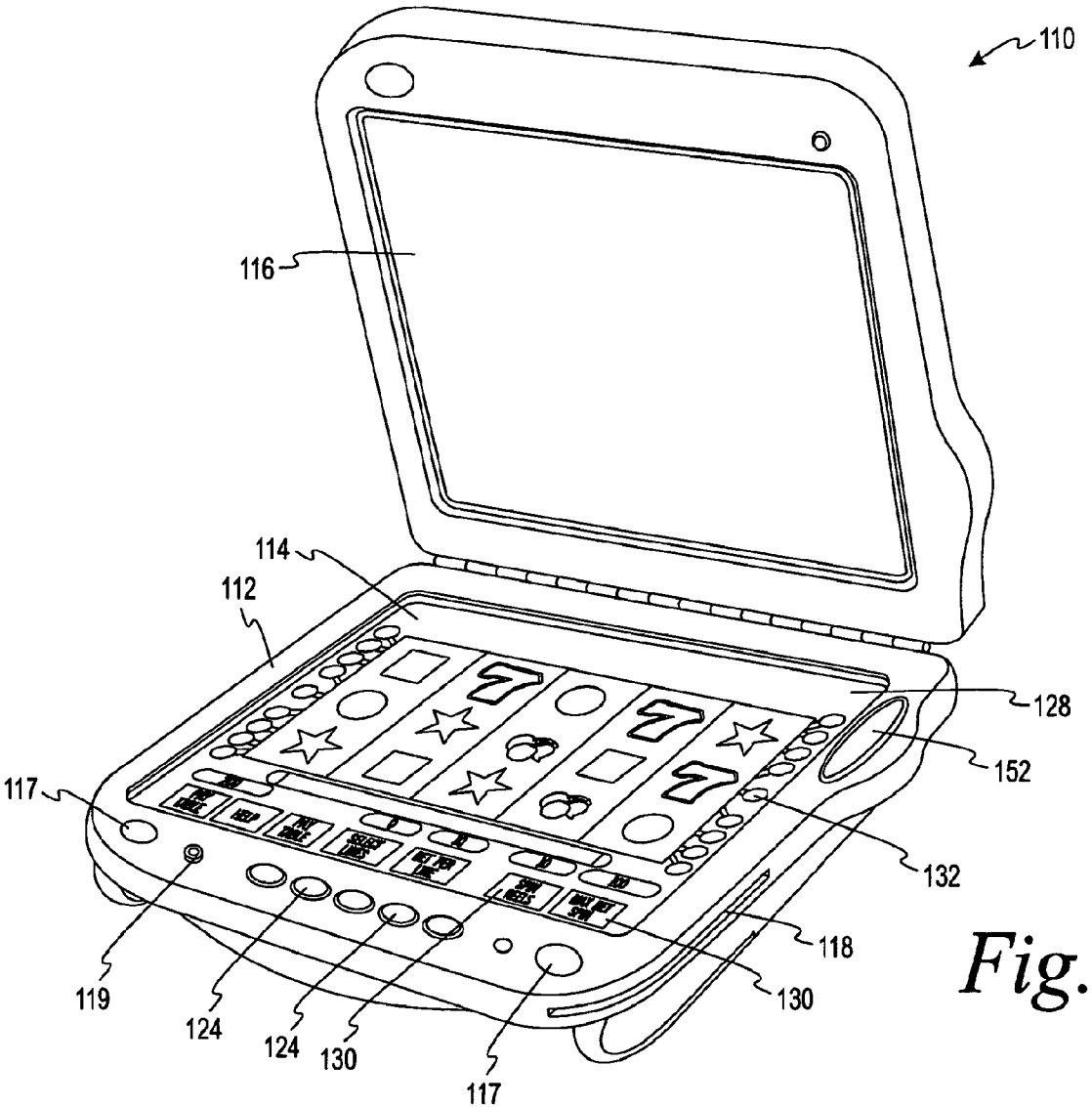
FIG. 1*b* is a perspective view of a handheld gaming machine embodying the present invention.

Depicted in FIG. 1*b* is a handheld or mobile gaming machine 110. Like the free standing gaming machine 10, the handheld gaming machine 110 is preferably an electronic gaming machine configured to play a video casino game such as, but not limited to, blackjack, slots, keno, poker, blackjack, and roulette. The handheld gaming machine 110 comprises a housing or casing 112 and includes input devices, including a value input device 118 and a player input device 124. For output the handheld gaming machine 110 includes, but is not limited to, a primary display 114, a secondary display 116, one or more speakers 117, one or more player-accessible ports 119 (e.g., an audio output jack for headphones, a video headset jack, etc.), and other conventional I/O devices and ports, which may or may not be player-accessible. In the embodiment depicted in FIG. 1*b*, the handheld gaming machine 110 comprises a secondary display 116 that is rotatable relative to the primary display 114. The optional secondary display 116 may be fixed, movable, and/or detachable/attachable relative to the primary display 114. Either the primary display 114 and/or secondary display 116 may be configured to display any aspect of a non-wagering game, wagering game, secondary games, bonus games, progressive wagering games, group games, shared-experience games or events, game events, game outcomes, scrolling information, text messaging, emails, alerts or announcements, broadcast information, subscription information, and handheld gaming machine status.

The player-accessible value input device 118 may comprise, for example, a slot located on the front, side, or top of the casing 112 configured to receive credit from a stored-value card (e.g., casino card, smart card, debit card, credit card, etc.) inserted by a player. In another aspect, the player-accessible value input device 118 may comprise a sensor (e.g., an RF sensor) configured to sense a signal (e.g., an RF signal) output by a transmitter (e.g., an RF transmitter) carried by a player. The player-accessible value input device 118 may also or alternatively include a ticket reader, or barcode scanner, for reading information stored on a credit ticket, a card, or other tangible portable credit or funds storage device. The credit ticket or card may also authorize access to a central account, which can transfer money to the handheld gaming machine 110.

Still other player-accessible value input devices 118 may require the use of touch keys 130 on the touch-screen display (e.g., primary display 114 and/or secondary display 116) or player input devices 124. Upon entry of player identification information and, preferably, secondary authorization information (e.g., a password, PIN number, stored value card number, predefined key sequences, etc.), the player may be permitted to access a player's account. As one potential optional security feature, the handheld gaming machine 110 may be configured to permit a player to only access an account the player has specifically set up for the handheld gaming machine 110. Other conventional security features may also be utilized to, for example, prevent unauthorized access to a player's account, to minimize an impact of any unauthorized access to a player's account, or to prevent unauthorized access to any personal information or funds temporarily stored on the handheld gaming machine 110.

The player-accessible value input device 118 may itself comprise or utilize a biometric player information reader which permits the player to access available funds on a player's account, either alone or in combination with another of the aforementioned player-accessible value input devices 118. In an embodiment wherein the player-accessible value input device 118 comprises a biometric player information reader, transactions such as an input of value to the handheld device, a transfer of value from one player account or source to an account associated with the handheld gaming machine 110, or the execution of another transaction, for example, could all be authorized by a biometric reading, which could comprise a plurality of biometric readings, from the biometric device.

Alternatively, to enhance security, a transaction may be optionally enabled only by a two-step process in which a secondary source confirms the identity indicated by a primary source. For example, a player-accessible value input device 118 comprising a biometric player information reader may require a confirmatory entry from another biometric player information reader 152, or from another source, such as a credit card, debit card, player ID card, fob key, PIN number, password, hotel room key, etc. Thus, a transaction may be enabled by, for example, a combination of the personal identification input (e.g., biometric input) with a secret PIN number, or a combination of a biometric input with a fob input, or a combination of a fob input with a PIN number, or a combination of a credit card input with a biometric input. Essentially, any two independent sources of identity, one of which is secure or personal to the player (e.g., biometric readings, PIN number, password, etc.) could be utilized to provide enhanced security prior to the electronic transfer of any funds. In another aspect, the value input device 118 may be provided remotely from the handheld gaming machine 110.

The player input device 124 comprises a plurality of push buttons 126 on a button panel for operating the handheld gaming machine 110. In addition, or alternatively, the player input device 124 may comprise a touch screen 128 mounted to a primary display 114 and/or secondary display 116. In one aspect, the touch screen 128 is matched to a display screen having one or more selectable touch keys 130 selectable by a user's touching of the associated of the screen using a finger or a tool, such as a stylus pointer. A player enables a desired function either by touching the touch screen 128 at an appropriate touch key 130 or by pressing an appropriate push button 126 on the button panel. The touch keys 130 may be used to implement the same functions as push buttons 126. Alternatively, the push buttons 126 may provide inputs for one aspect of the operating the game, while the touch keys 130 may allow for input needed for another aspect of the game. The various components of the handheld gaming machine 110 may be connected directly to, or contained within, the casing 112, as seen in FIG. 1*b*, or may be located outboard of the casing 112 and connected to the casing 112 via a variety of hardwired (tethered) or wireless connection methods. Thus, the handheld gaming machine 110 may comprise a single unit or a plurality of interconnected parts (e.g., wireless connections) which may be arranged to suit a player's preferences.

The operation of the basic wagering game on the handheld gaming machine 110 is displayed to the player on the primary display 114. The primary display 114 can also display the bonus game associated with the basic wagering game. The primary display 114 preferably takes the form of a high resolution LCD, a plasma display, an LED, or any other type of display suitable for use in the handheld gaming machine 110. The size of the primary display 114 may vary from, for example, about a 2-3" display to a 15" or 17" display. In at least some aspects, the primary display 114 is a 7"-10" display. As the weight of and/or power requirements of such displays decreases with improvements in technology, it is envisaged that the size of the primary display may be increased. Optionally, coatings or removable films or sheets may be applied to the display to provide desired characteristics (e.g., anti-scratch, anti-glare, bacterially-resistant and anti-microbial films, etc.). In at least some embodiments, the primary display 114 and/or secondary display 116 may have a 16:9 aspect ratio or other aspect ratio (e.g., 4:3). The primary display 114 and/or secondary display 116 may also each have different resolutions, different color schemes, and different aspect ratios.

As with the free standing gaming machine 10, a player begins play of the basic wagering game on the handheld gaming machine 110 by making a wager (e.g., via the value input device 18 or an assignment a credits stored on the handheld gaming machine via the touch screen keys 130, player input device 124, or buttons 126) on the handheld gaming machine 10. In at least some aspects, the basic game may comprise a plurality of symbols arranged in an array, and includes at least one payline 132 that indicates one or more outcomes of the basic game. Such outcomes are randomly selected in response to the wagering input by the player. At least one of the plurality of randomly selected outcomes may be a start-bonus outcome, which can include any variations of symbols or symbol combinations triggering a bonus game.

In some embodiments, the player-accessible value input device 118 of the handheld gaming machine 110 may double as a player information reader 152 that allows for identification of a player by reading a card with information indicating the player's identity (e.g., reading a player's credit card, player ID card, smart card, etc.). The player information reader 152 may alternatively or also comprise a bar code scanner, RFID transceiver or computer readable storage medium interface. In one presently preferred aspect, the player information reader 152, shown by way of example in FIG. 1, comprises a biometric sensing device.

Figure 2:
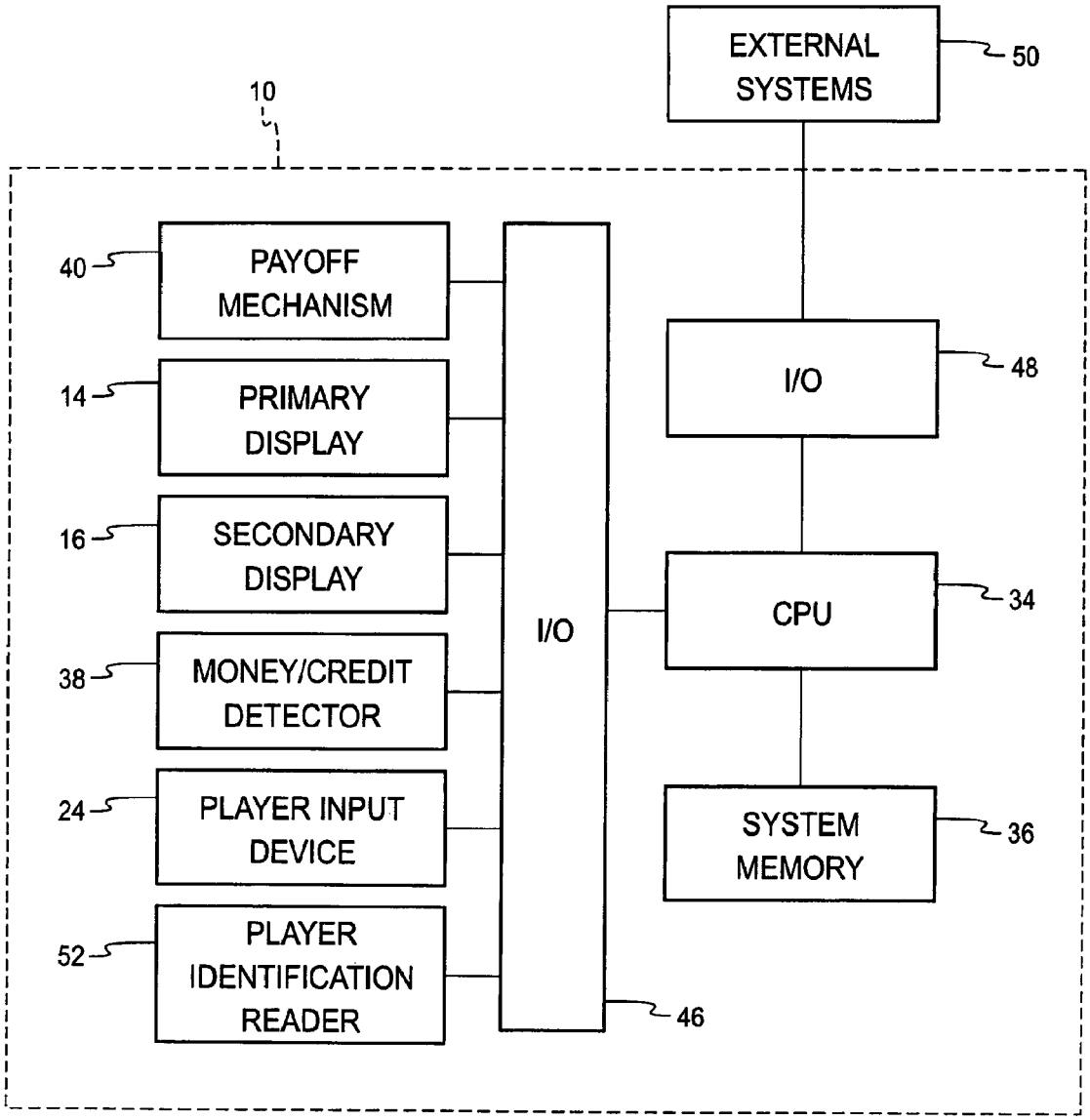
FIG. 2 is a block diagram of a control system suitable for operating the gaming machine.

Turning now to FIG. 2, the various components of the gaming machine 10 are controlled by a central processing unit (CPU) 34, also referred to herein as a controller or processor (such as a microcontroller or microprocessor). To provide gaming functions, the controller 34 executes one or more game programs stored in a computer readable storage medium, in the form of memory 36. The controller 34 performs the random selection (using a random number generator (RNG)) of an outcome from the plurality of possible outcomes of the wagering game. Alternatively, the random event may be determined at a remote controller. The remote controller may use either an RNG or pooling scheme for its central determination of a game outcome. It should be appreciated that the controller 34 may include one or more microprocessors, including but not limited to a master processor, a slave processor, and a secondary or parallel processor.

The controller 34 is also coupled to the system memory 36 and a money/credit detector 38. The system memory 36 may comprise a volatile memory (e.g., a random-access memory (RAM)) and a non-volatile memory (e.g., an EEPROM). The system memory 36 may include multiple RAM and multiple program memories. The money/credit detector 38 signals the processor that money and/or credits have been input via the value input device 18. Preferably, these components are located within the housing 12 of the gaming machine 10. However, as explained above, these components may be located outboard of the housing 12 and connected to the remainder of the components of the gaming machine 10 via a variety of different wired or wireless connection methods.

As seen in FIG. 2, the controller 34 is also connected to, and controls, the primary display 14, the player input device 24, and a payoff mechanism 40. The payoff mechanism 40 is operable in response to instructions from the controller 34 to award a payoff to the player in response to certain winning outcomes that might occur in the basic game or the bonus game(s). The payoff may be provided in the form of points, bills, tickets, coupons, cards, etc. For example, in FIG. 1, the payoff mechanism 40 includes both a ticket printer 42 and a coin outlet 44. However, any of a variety of payoff mechanisms 40 well known in the art may be implemented, including cards, coins, tickets, smartcards, cash, etc. The payoff amounts distributed by the payoff mechanism 40 are determined by one or more pay tables stored in the system memory 36.

Communications between the controller 34 and both the peripheral components of the gaming machine 10 and external systems 50 occur through input/output (I/O) circuits 46, 48. More specifically, the controller 34 controls and receives inputs from the peripheral components of the gaming machine 10 through the input/output circuits 46. Further, the controller 34 communicates with the external systems 50 via the I/O circuits 48 and a communication path (e.g., serial, parallel, IR, RC, 10bT, etc.). The external systems 50 may include a gaming network, other gaming machines, a gaming server, communications hardware, or a variety of other interfaced systems or components. Although the I/O circuits 46, 48 may be shown as a single block, it should be appreciated that each of the I/O circuits 46, 48 may include a number of different types of I/O circuits.

Controller 34, as used herein, comprises any combination of hardware, software, and/or firmware that may be disposed or resident inside and/or outside of the gaming machine 10 that may communicate with and/or control the transfer of data between the gaming machine 10 and a bus, another computer, processor, or device and/or a service and/or a network. The controller 34 may comprise one or more controllers or processors. In FIG. 2, the controller 34 in the gaming machine 10 is depicted as comprising a CPU, but the controller 34 may alternatively comprise a CPU in combination with other components, such as the I/O circuits 46, 48 and the system memory 36.

The gaming machines 10,110 may communicate with external systems 50 (in a wired or wireless manner) such that each machine operates as a "thin client," having relatively less functionality, a "thick client," having relatively more functionality, or through any range of functionality therebetween. As a generally "thin client," the gaming machine may operate primarily as a display device to display the results of gaming outcomes processed externally, for example, on a server as part of the external systems 50. In this "thin client" configuration, the server executes game code and determines game outcomes (e.g., with a random number generator), while the controller 34 on board the gaming machine processes display information to be displayed on the display(s) of the machine. In an alternative "rich client" configuration, the server determines game outcomes, while the controller 34 on board the gaming machine executes game code and processes display information to be displayed on the display(s) of the machines. In yet another alternative "thick client" configuration, the controller 34 on board the gaming machine 110 executes game code, determines game outcomes, and processes display information to be displayed on the display(s) of the machine. Numerous alternative configurations are possible such that the aforementioned and other functions may be performed onboard or external to the gaming machine as may be necessary for particular applications. It should be understood that the gaming machines 10,110 may take on a wide variety of forms such as a free standing machine, a portable or handheld device primarily used for gaming, a mobile telecommunications device such as a mobile telephone or personal daily assistant (PDA), a counter top or bar top gaming machine, or other personal electronic device such as a portable television, MP3 player, entertainment device, etc.

Figure 3:
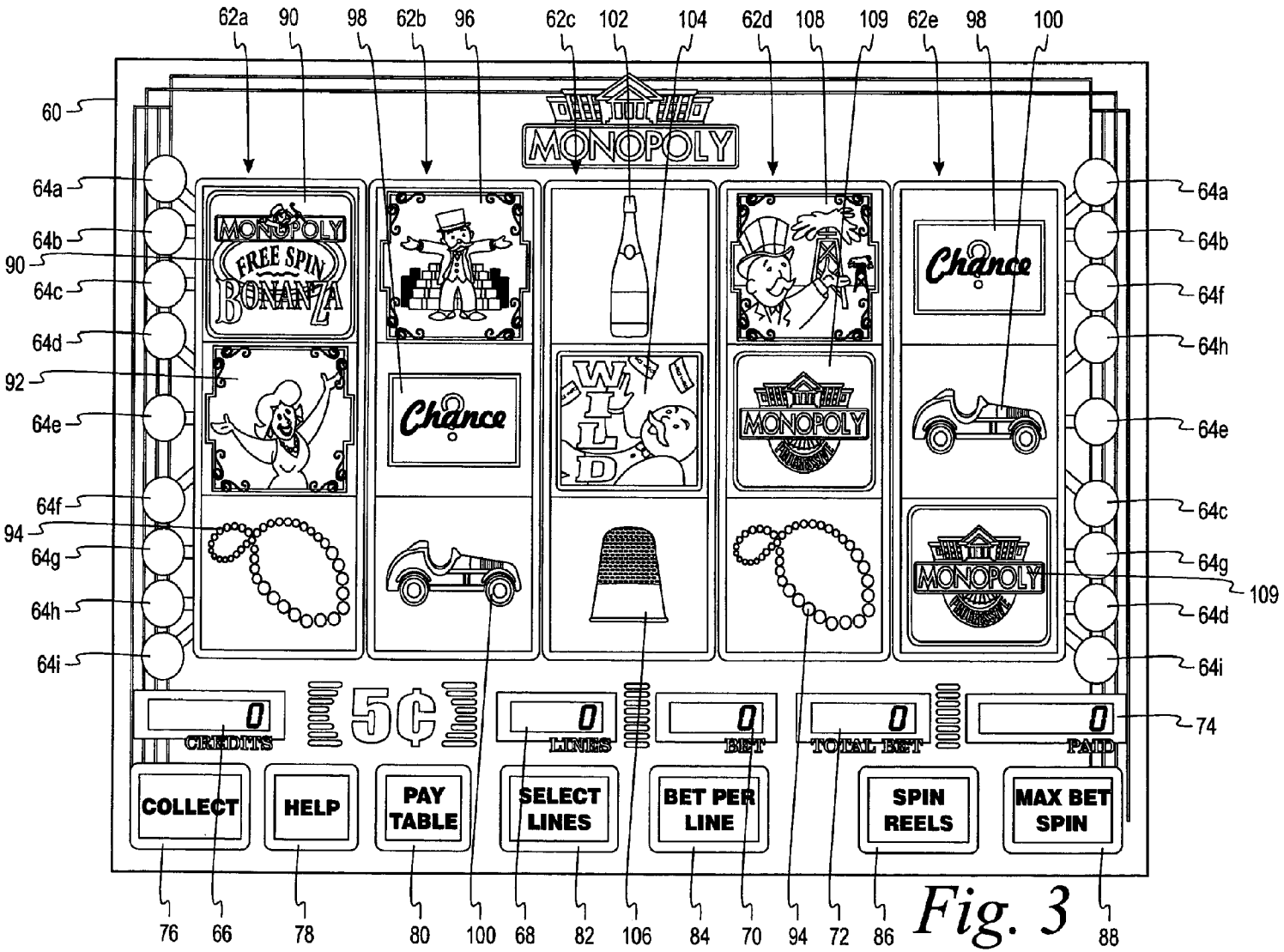
FIG. 3 is a screen view of a basic game capable of being displayed on the gaming machine of FIG. 1.

Turning now to FIG. 3, an image of a main game screen 60 is illustrated, according to one embodiment of the present invention. A player begins play of a basic wagering game by inserting a wager into the value input device 18 of the gaming machine 10. A player can select play by using the player input device 24, via the buttons 26 or the touch screen keys 30. The CPU 34 (or a wagering game control network in alternative embodiments) operates to execute a wagering game program causing the primary display 14 to display the wagering game that includes a plurality of visual elements.

The basic game screen 60 may be displayed on the primary display 14 or on a portion thereof. In the illustrated embodiment, the basic game screen 60 is used to display a plurality of simulated, movable reels 62*a-e* with symbols displayed thereon. The reels 62*a-e* are positioned such that the symbols are displayed relative to at least one payline (e.g., a payline 129 in FIG. 4), yielding a plurality of outcomes for the basic game. The basic game screen 60 may also display a plurality of game session meters and various buttons selectable by a player. The game session meters include a "credit" meter 66 for displaying a number of credits available for play on the machine; a "lines" meter 68 for displaying a number of paylines to be played by a player on the machine; a "line bet" meter 70 for displaying a number of credits wagered (e.g., from 1 to 5 credits) for each of the number of paylines played; a "total bet" meter 72 for displaying a total number of credits wagered for the particular round of wagering; and a "paid" meter 74 for displaying an amount to be awarded based on the results of the particular rounds wager. The user-selectable buttons include a "collect" button 76 to collect the credits remaining in the credits meter 66; a "help" button 78 for viewing instructions on how to play the wagering game; a "pay table" button 80 for viewing a pay table associated with the basic wagering game; a "select lines" button 82 for changing the number of paylines (displayed in the lines meter 68) a player wishes to play; a "bet per line" button 84 for changing the amount of the wager which is displayed in the line bet meter 70; a "spin reels" button 86 for moving the reels 62*a-e*; and a "max bet spin" button 88 for wagering a maximum number of credits and moving the reels 62*a-e* of the basic wagering game. While the gaming machine 10, 110 allows for these types of player inputs, the present invention does not require them and can be used on gaming terminals having more, less, or different player inputs.

In FIG. 3, the five depicted reels 62*a-e* have a plurality of symbols displayed thereon and at least one activated payline extending from one of the payline indicators 64*a-i* on the left side of the screen 60 to the corresponding payline indicators 64*a-i* on the right side of the screen 60. The plurality of symbols displayed on the reels 62*a-e* are used to indicate a plurality of possible outcomes along each of the activated paylines. The depicted symbols all correspond to a "MONOPOLY" theme and include: "FREE SPIN BONUS" symbols 90; "MS. MONOPOLY" symbols 92; "PEARLS" symbols 94; "MR. MONOPOLY WITH MONEY" symbols 96; "CHANCE CARD" symbols 98; "CAR" symbols 100; "CHAMPAGNE" symbols 102; "LOGO (WILD)" symbols 104; "THIMBLE" symbols 106; "MR. MONOPOLY AND OIL FIELD" symbols 108; and "MONOPOLY PROGRESSIVE" symbols 109. Other MONOPOLY-themed symbols may also be depicted. In other embodiments of the present invention, the gaming machine 10, 110 may portray other themes with corresponding like-themed symbols. Further, standard gaming symbols such as "1-BAR" symbols, "2-BAR" symbols, "3-BAR" symbols, "CHERRY" symbols, "SEVEN" symbols, and "BELL" symbols may be depicted on the reels 62*a-e* in other embodiments. The reels 62*a-e* displaying these symbols may be either traditional mechanical reels or they may be computer-generated images of reels.

A winning combination occurs when the symbols appearing on the reels 62*a-e* along an active payline correspond to one of the winning symbol combinations listed in a pay table stored in the system memory 36 of the gaming machine 10, 110. The pay table may also be displayed on the secondary display 16, the primary display 14, or both and be either displayed constantly, intermittently, or upon request by a player (e.g., by selecting the pay-table button 80). Winning combinations listed in the pay table can include three like-symbols appearing on a payline yielding a first payout, four like-symbols appearing on a payline yielding a second, larger payout, and five like-symbols appearing on a payline yielding a third, even larger payout.

Figure 4:
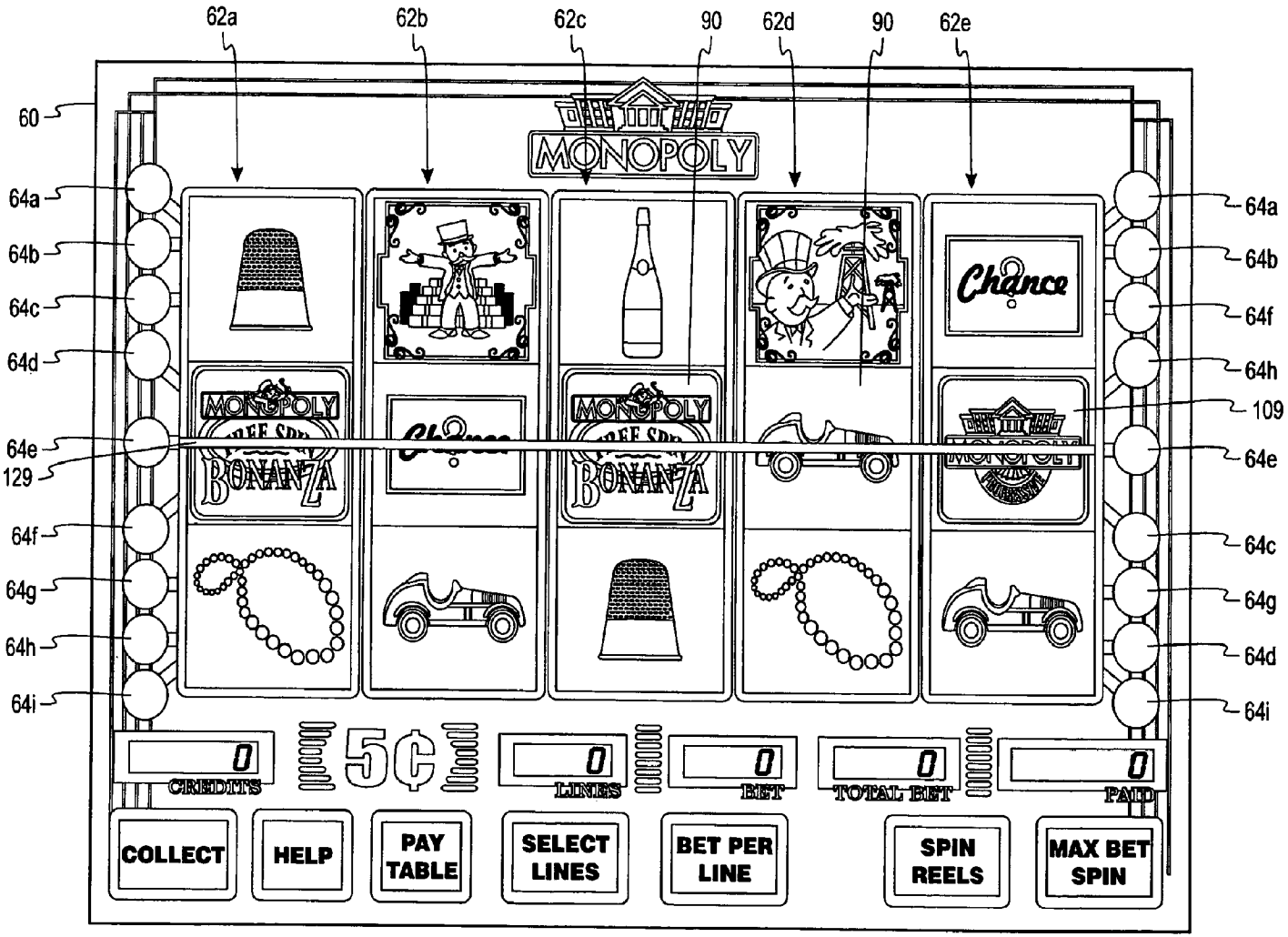
FIG. 4 is a screen view of the reels of the basic game of FIG. 3 after the reels have been spun.

A player may play multiple paylines by selecting the select-lines button 82 until the desired number of paylines (up to nine in the illustrated embodiment) are displayed. While an embodiment with nine paylines is shown, a gaming machine 10, 110 with a single payline; or multiple paylines will also work with the present invention. Additionally, although an embodiment with five reels is shown, a gaming machine 10 with any plurality of reels may also be used in accordance with the present invention:

During basic game play, a bonus game may be triggered in a number of ways. According to one embodiment, three or more bonus symbols on an active payline in the basic game triggers a bonus game. Bonus symbols may include various designated symbols. In the illustrated embodiment, the bonus symbols include the Free Spin Bonus Symbol 90, the Chance Card 98, and the Monopoly Progressive 109. Referring to FIG. 4, the reels 62*a-e* are displayed after they have stopped spinning. Assuming the player activated a payline 129 corresponding to payline indicators 64*e*, a bonus game is triggered because three bonus symbols (two Free Spin Bonus Symbols 90 and one Monopoly Progressive Symbol 109) have landed along the payline 129. The bonus game may be triggered in a number of ways and the method of achieving a bonus game described herein is provided by way of example and should not limit the present invention. Any method of achieving a bonus game from basic game play is contemplated as falling within the present invention.

The bonus game that has been triggered by the symbol combination of FIG. 4 includes at least one free spin of the reels—a free-spin event. Additional free spins may also be awarded during play of the free-spin event if certain conditions are satisfied. For example, during a free-spin, three or more scattered bonus trigger symbols may award an additional ten free spins. The bonus can in theory, be infinitely re-triggered.

Figure 5:
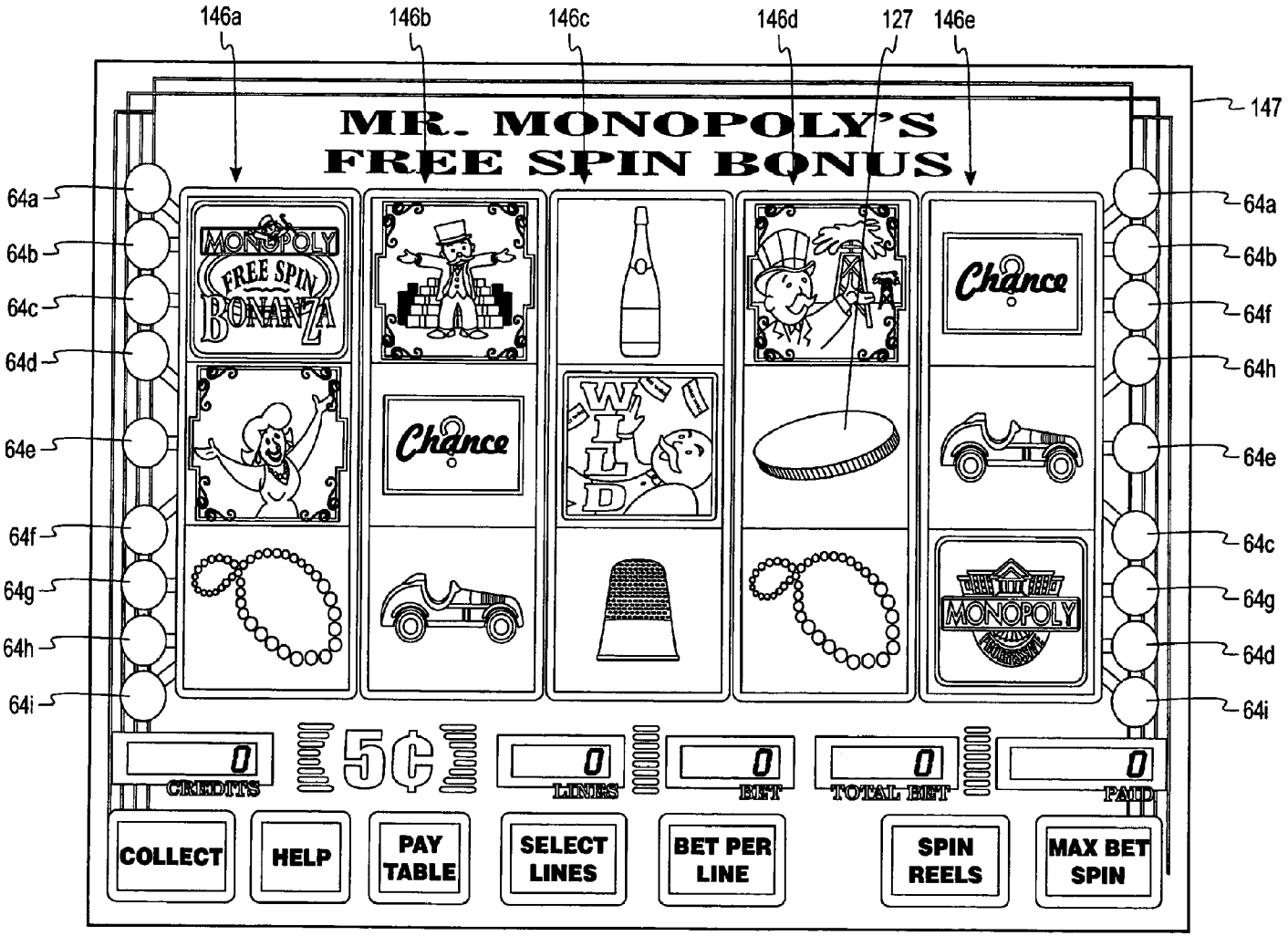
FIG. 5 is a screen view of the reels of a bonus game after the reels have been spun.

Referring now to FIG. 5, the bonus game is displayed on game screen 147 with reels 146*a-e*. The reels 146*a-e*, as illustrated in FIG. 5, have been spun as a result of the free-spin event in the bonus game. Certain results of the free-spin event trigger a special-event. For example, one way of achieving the special-event is by the appearance of a pre-determined symbol on one of the reels 146*a*-146*e*. In the illustrated embodiment, a Token symbol 127 is designated as the special-event-triggering symbol. As shown in FIG. 5, the Token symbol 127 appears on the reel 146*d* after the reels 146*a*-146*e* have been spun. Therefore, a special-event is triggered in accordance with this embodiment. Other methods of triggering the special-event within the free-spin bonus may also be employed. For example, the special-event may be triggered by certain symbol combinations on an active payline, certain scatter symbol combinations, based upon time on device, coin-in, or may even be triggered randomly.

Figure 6:
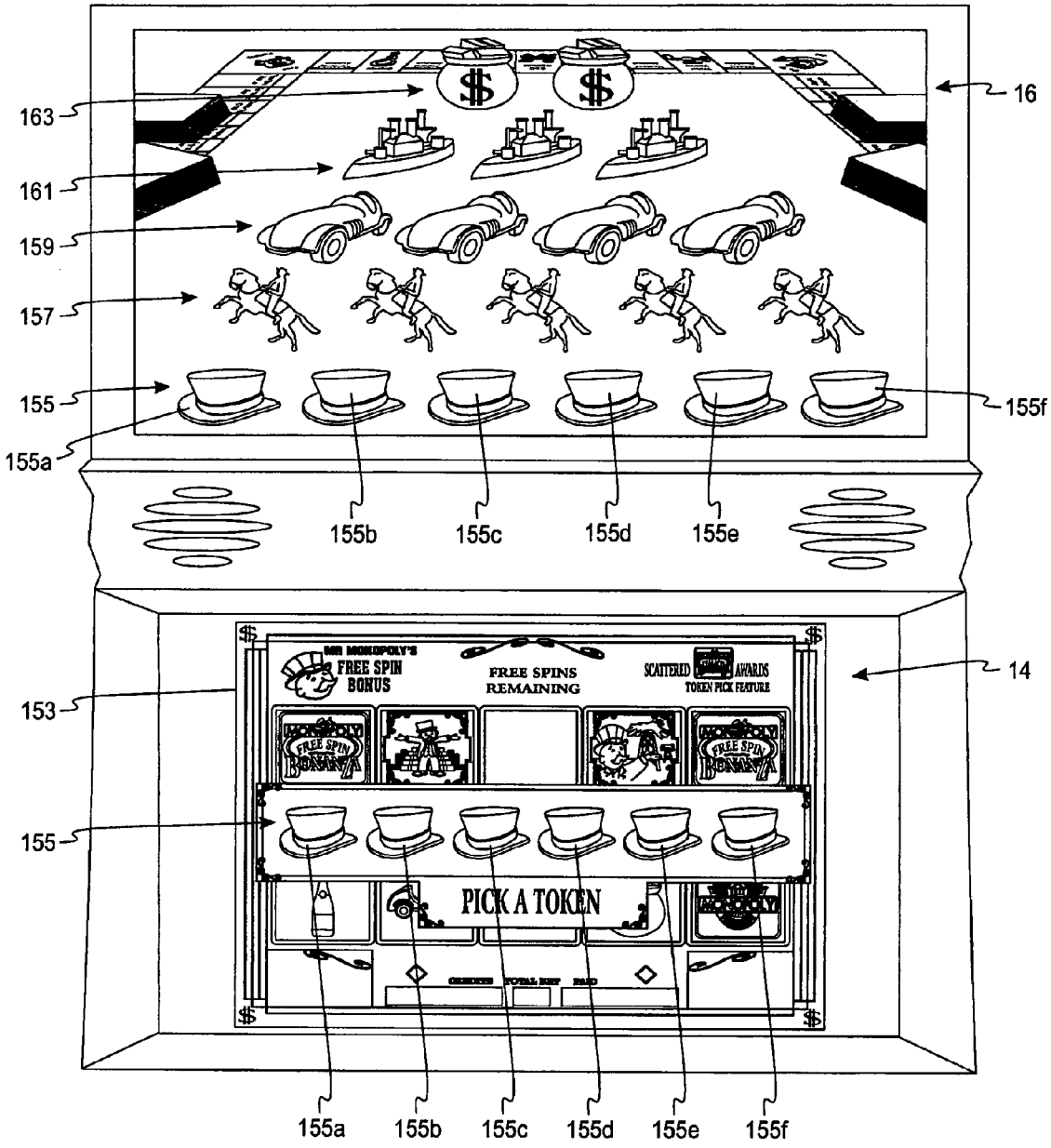
FIG. 6 is a screen view of a special-event.

Once the special-event is triggered, the game screen 147 transitions into a game screen 153 that reveals a first selection group 155 having player-selectable Hat symbols 155*a-f*, as illustrated in FIG. 6. When the primary display 14 makes this transition, the secondary display 16 may concurrently display a plurality of levels, each including one or more additional player-selectable symbols.

The plurality of levels displayed on the secondary display 16 includes selection groups 155, 157, 159, 161, 163 of player-selectable symbols potentially available for selection on the game screen 153. Initially, the first selection group 155 of player-selectable Hat symbols 155*a-f* is displayed on the game screen 153 of the primary display 14 and is concurrently displayed on the secondary display 16.

The first selection group 155 comprises the first level of Hat symbols 155*a-f* on the secondary display 16. Above the first selection group 155 is a second selection group 157 comprising a level of Horse symbols. A third selection group 159 comprises the next level of Car symbols. A fourth selection group 161, above the Car symbols, comprises Boat symbols. And a fifth selection group 163 displayed above the Car symbols comprises Money symbols.

Figure 7:
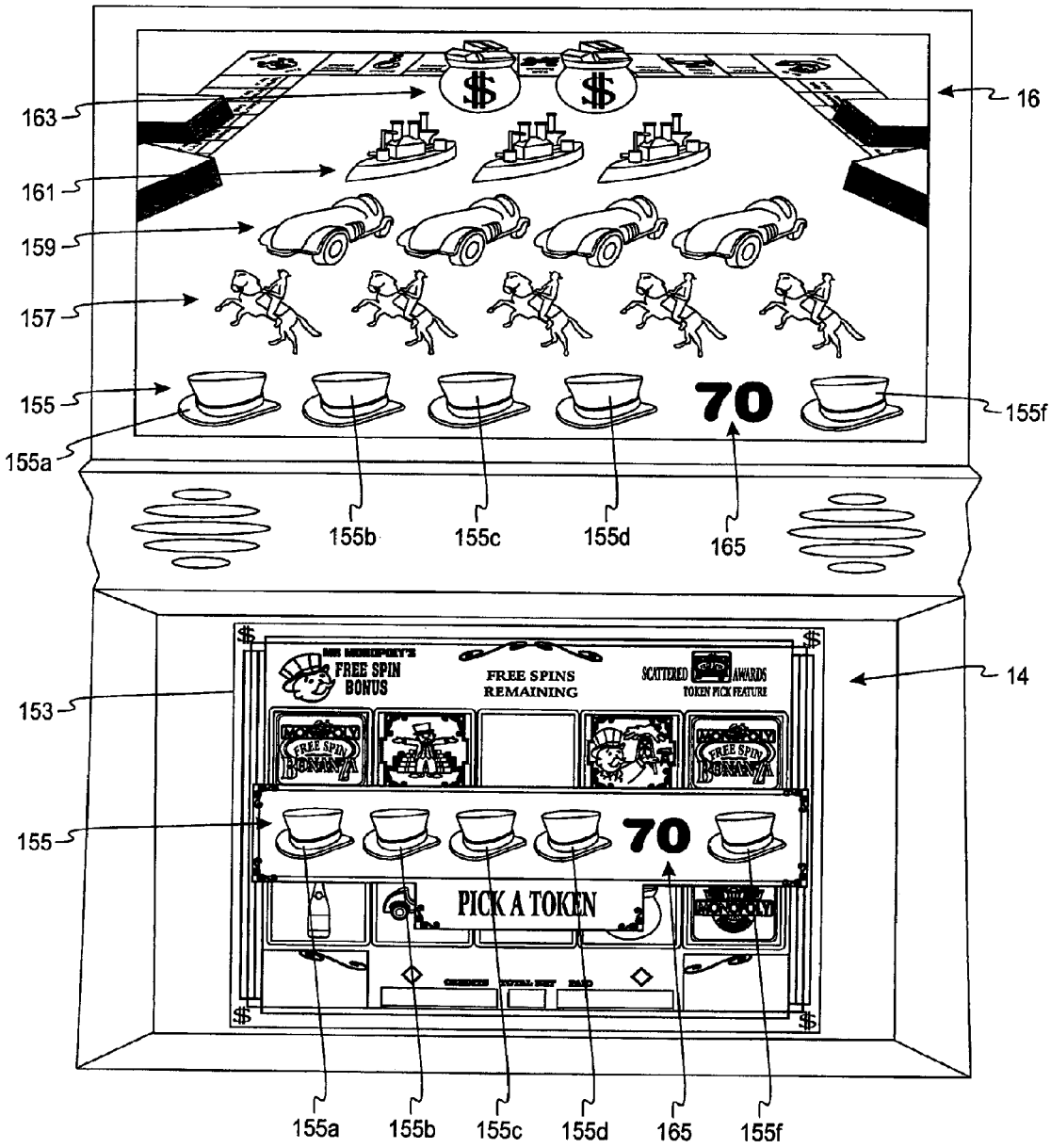
FIG. 7 is a screen view of the special-event of FIG. 6 after a player-selectable symbol has been selected.

The player is first prompted to pick a Hat symbol 155*a-f* from the first selection group 155 on the game screen 153. Upon selection, various awards may be revealed such as a credit amount or a credit amount plus level-advance award. Referring now to FIG. 7, the Hat symbol 155*e* from the first selection group 155 has been selected. The award masked by the Hat symbol 155*e* is a credit amount 165. The corresponding Hat symbol 155*e* displayed on the secondary display 16 also reveals that the Hat symbol 155*e* of the first selection group 155 has been selected by revealing the credit amount 165. Alternatively, a credit amount plus a level-advance award may be revealed upon selection of a symbol masking that type of award. For example, instead of choosing the Hat symbol 155*e* masking a credit amount, as illustrated in FIG. 7, assume a Hat symbol, masking a credit amount plus level-advance award, was chosen. The credit amount plus-level advance award would be revealed on the game screen 153 on the primary display 14. Likewise, the credit amount plus level-advance award would also be revealed on the secondary display 16.

Regardless of the type of award won, the state of the special-event is saved for subsequent return. As such, upon selection of the Hat symbol 155*e* masking a credit amount, and the display of the credit amount 165, the player is awarded the credit amount displayed and the display 14 returns to display the game screen 147 of the free-spin event, illustrated in FIG. 5. In other words, the special-event is essentially paused while the player returns to the free spin bonus game to play out the remaining free spins. During any of the remaining free-spins, if another Token symbol 127 (or other pre-determined special-event trigger in other embodiments) appears on the game screen 147 after the reels 146*a*-146*e* have been spun, the player is returned to the special-event of FIGS. 6-8. The player may continue playing the special-event from the point that it had been saved for the player. Accordingly, the credit amount 165 of FIG. 7 remains displayed in the location previously occupied by the Hat symbol 155*e*. Furthermore, symbol 155*e* is no longer available for selection by the player as having been previously selected.

Figure 8:
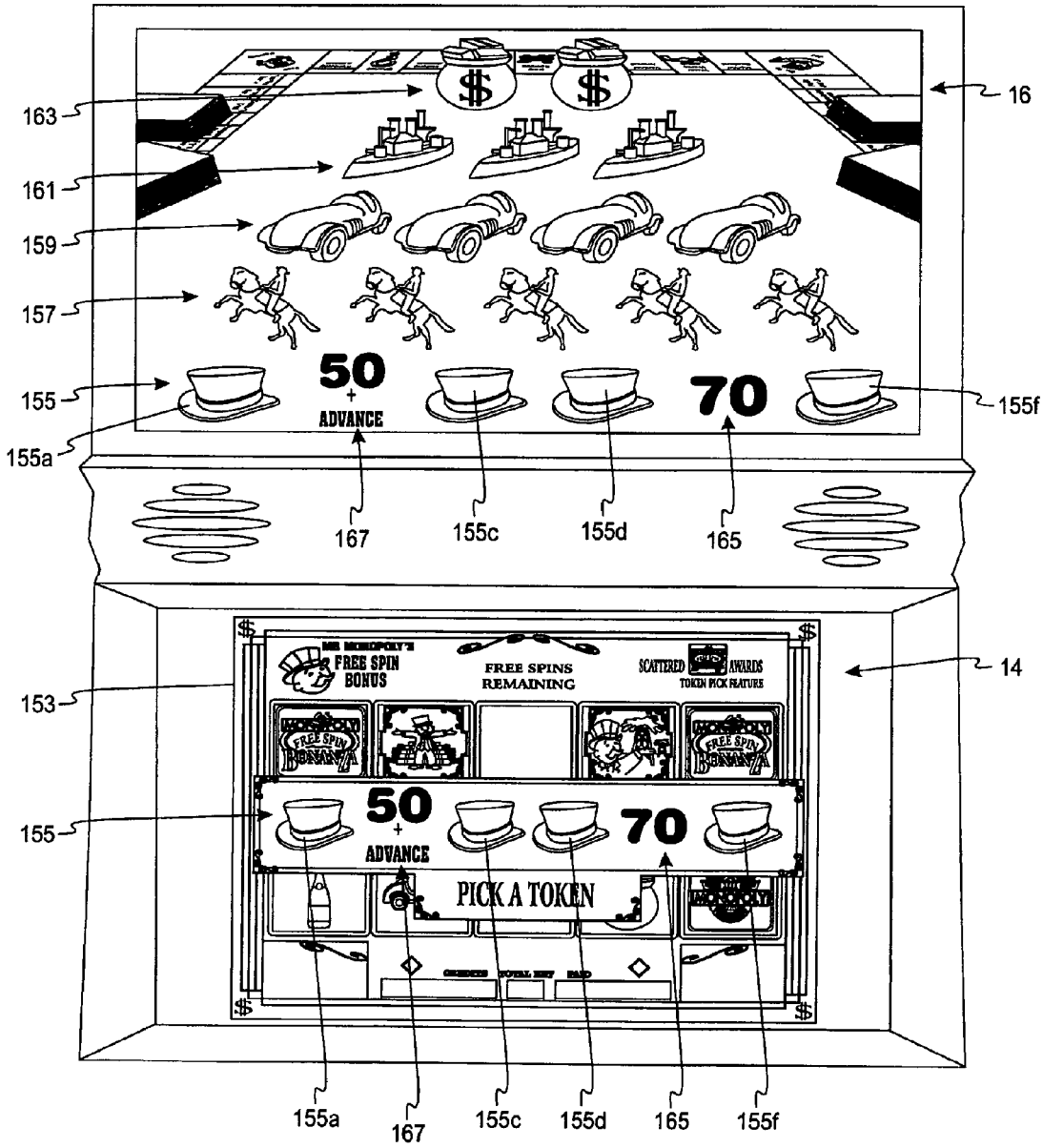
FIG. 8 is a screen view of the special-event after the special-event has been achieved twice.

The player is prompted to select another player-selectable element from the first selection group 155—one of the remaining Hat symbols. Referring now to FIG. 8, the player selects a Hat symbol 155*b* which reveals a credit amount plus level-advance award 167. In this case, the player is awarded the credit amount revealed and the next level of selection groups, the second selection group 157 of Horse symbols, is "unlocked." Essentially, this means that the next time the player returns to the special-event from the free-spin event (i.e., when the Token symbol 127 is displayed in this embodiment), the Horse symbols in the second selection group 157 will be available for selection.

After the credit amount initially masked by the selected Hat symbol 155*b* is awarded, the player is again returned to the free-spin event of FIG. 5. Should another Token symbol 127 appear on one of the reels 146*a-e* during the remainder of the free-spin event, the player will return to the special-event again to continue selecting from the point of the most recent saved state of the special event. If returned to the special-event, the player would now select from the second selection group 157 of Horse symbols due to the credit amount plus level-advance award 167 revealed during the last play of the special-event. In one preferred embodiment, the credit amounts awarded in the second selection group 157 of Horse symbols may be worth more value than the player-selectable Hat symbols of the first selection group 155.

Upon selection of a Horse symbol in the second selection group 157, regardless of whether the award is a credit amount or a credit amount plus level-advance award (or other awards in other embodiments), the player returns to free-spin bonus game play. The game state of the special-event is again saved and this cycle continues until either the player is left without any remaining free spins in the bonus game or the player has selected from all available selection groups (i.e., selection groups 155, 157, 159, 161, 163 in this embodiment). Each level achieved may result in higher credit amounts awarded. Furthermore, upon achieving the highest level (i.e., the fifth selection group 163 of Money symbols in this embodiment), a special award may be won.

In some embodiments, the saved state of the special-event is maintained even after the free-spin event (of FIG. 5) is complete. Thus, after the player triggers the free-spin event in the basic game (for the second time) and the Token symbol 127 appears in the free-spin event of FIG. 5, the special-event picks up where it left off. In yet another alternative embodiment, some of the selectable elements in the special-event may include an immediate additional pick which the player is able to make prior to returning to the free-spin game. In this way, the player may be able to select more than one selection during each visit to the special-event game. In some other embodiments, additional types of awards may be masked by some of the selectable elements in the special-event. For example, one additional type of award may be a multiplier-of-next pick award. This type of award will multiply a subsequently picked award (initially masked by a selectable element) by an integer or non-integer value associated with the multiplier-of-next pick award. Other types of awards are also contemplated in accordance with the present invention. In yet other embodiments, the selectable elements may also mask non-award items, such as a special-event ending item. The special-event would end if a selectable element masking a special-event ending item was selected.

Each of these embodiments and obvious variations thereof is contemplated as falling within the spirit and scope of the claimed invention, which is set forth in the following claims.

What is claimed is:

1. A gaming machine for playing a wagering game, comprising:

at least one display for displaying a randomly selected outcome of a basic game of the wagering game, the basic game including at least one free-spin event outcome, the wagering game including a free-spin event having a plurality of free spins and one or more special event outcomes;

a memory device; and a controller coupled to the display and the memory device, the controller operative to implement the following acts including initiating the basic game;

in response to a free-spin event outcome in the basic game, initiating the free-spin event;

implementing a free spin of the plurality of free spins and displaying the outcome on the display;

in response to achieving at least one of the one or more special-event outcomes during the free spin of the plurality of free spins, initiating a special event, the special event comprising a plurality of levels, each level having player-selectable elements masking associated awards, at least one of the associated awards including a level-advance outcome;

receiving a selection of a player-selectable element from the plurality of player-selectable elements in a current level of the plurality of levels and unmasking the award associated with the selected element;

after receiving the selection, storing a state of the special event on the memory device;

implementing another free spin of the plurality of free spins;

in response to achieving at least one of the one or more special event outcomes during the another free spin of the plurality of free spins, resuming the special event at the stored state of the special event;

if the unmasked award associated with the selected element in the current level does not include the level-advance outcome, receiving a selection of another player-selectable element from the plurality of player-selectable elements in the current level and unmasking the award associated with the another selected element in the current level; and if the unmasked award associated with the selected element in the current level includes the level-advance outcome, receiving a selection of a player-selectable element from a plurality of player-selectable elements in a next level of the plurality of levels and unmasking an award associated with the selected element in the next level.

2. The gaming machine of claim 1, wherein the plurality of levels are displayed on the display, the plurality of levels including a first selection group and a second selection group, the first selection group being the current level of the plurality of levels and the second selection group being the next level of the plurality of levels.

3. The gaming machine of claim 2, wherein the plurality of levels include a third selection group, the third selection group being the third level of the plurality of levels, the third selection group being achievable upon selection of a player-selectable element in the second selection group masking a level-advance outcome.

4. The gaming machine of claim 1, wherein the level-advance outcome also includes a credit amount awarded to the player.

5. The gaming machine of claim 1, wherein the special-event outcome for permitting play of the special event is a scatter-award symbol displayed on at least one of a plurality of reels of the wagering game.

6. The gaming machine of claim 1, wherein the next level of the plurality of levels includes awards having increased credit amounts over awards of the current level.

7. The gaming machine of claim 1, wherein a special award is achieved in response to advancing to a highest level of the plurality of levels.

8. The gaming machine of claim 1, wherein at least one of the plurality of player-selectable elements masks a non-award item.

9. A method of conducting a wagering game on a gaming machine, the method comprising:

initiating, via one or more processors, a basic game of the wagering game, the wagering game further including a free-spin event and a special event, the basic game including at least one free-spin event outcome;

initiating, via at least one of the one or more processors, the free-spin event in response to achieving the free-spin event outcome in the basic game, the free-spin event including a plurality of free spins and one or more special-event outcomes;

conducting a first free spin of the plurality of free spins;

initiating, via at least one of the one or more processors, the special event in response to achieving at least one of the one or more special-event outcomes during the first free spin of the plurality of free spins, the special event comprising a plurality of levels, each level having a plurality of player-selectable elements that mask associated awards, at least one of the awards including a level-advance outcome;

receiving a selection of at least one player-selectable element from the plurality of player-selectable elements in a current level of the plurality of levels and unmasking the award associated with the selected element;

after receiving the selection, storing in a memory a special-event game state for later use in the free-spin event;

conducting another free spin of the plurality of free spins;

in response to achieving at least one of the one or more special-event outcomes during the another free spin, resuming the special event at the stored special-event game state;

in response to the unmasked award associated with the selected element in the current level not including the level-advance outcome, receiving a selection of another player-selectable element from the plurality of player-selectable elements in the current level and unmasking the award associated with the another selected element in the current level; and in response to the unmasked award associated with the selected element in the current level including the level-advance outcome, receiving a selection of a player-selectable element from a plurality of player-selectable elements in a next level of the plurality of levels and unmasking an award associated with the selected element in the next level.

10. The method of claim 9, wherein the selected player-selectable element is no longer available for selection upon resuming the special event.

11. The method of claim 9, wherein the next level of the plurality of levels includes awards having increased credit amounts over awards of the current level.

12. The method of claim 9, wherein a special award is achieved in response to advancing to a highest level of the plurality of levels.

13. The method of claim 9, wherein the plurality of levels include a first selection group and a second selection group, the first selection group being the current level of the plurality of levels and the second selection group being the next level of the plurality of levels.

14. The method of claim 9, wherein the level-advance outcome also includes a credit amount awarded to the player.

15. The method of claim 9, wherein the special-event outcome for permitting play of the special event is a scatter-award symbol displayed on at least one of a plurality of reels of a slots game.

16. A computer program product comprising a non-transitory computer readable medium having an instruction set borne thereby, the instruction set being configured to cause, upon execution by one or more processors associated with a gaming system, the acts of:

initiating a basic game of a wagering game via at least one of the one or more processors, the wagering game including a free-spin event and the basic game including at least one free-spin event outcome;

in response to a free-spin event outcome in the basic game, initiating the free-spin event via at least one of the one or more processors, the free-spin event including a plurality of free spins and one or more special-event outcomes;

implementing a free spin of the plurality of free spins;

in response to achieving at least one of the one or more special-event outcomes during the free spin of the plurality of free spins, initiating a special event via at least one of the one or more processors, the special event including a plurality of levels, each level having a plurality of player-selectable elements that mask associated awards, at least one of the associated awards including a level-advance outcome;

receiving a selection of a player-selectable element from the plurality of player-selectable elements in a current level of the plurality of levels and unmasking the award associated with the selected element;

after receiving the selection, storing in a memory device a state of the special event;

implementing another free spin of the plurality of free spins;

in response to achieving at least one of the one or more special event outcomes during the another free spin of the plurality of free spins, resuming the special event at the stored state of the special event;

if the unmasked award associated with the selected element in the current level does not include the level-advance outcome, receiving a selection of another player-selectable element from the plurality of player-selectable elements in the current level and unmasking the award associated with the another selected element in the current level; and if the unmasked award associated with the selected element in the current level includes the level-advance outcome, receiving a selection of a player-selectable element from a plurality of player-selectable elements in a next level of the plurality of levels and unmasking an award associated with the selected element in the next level.

17. The computer program product of claim 16, wherein the selected player-selectable element is no longer available for selection upon returning to the special event.

18. The computer program product of claim 16, wherein the next level of the plurality of levels includes awards having increased credit amounts over awards of the current level of the plurality of levels.

19. The computer program product of claim 16, wherein a special award is achieved in response to advancing to a highest level of the plurality of levels.

20. The computer program product of claim 16, wherein at least one of the plurality of player-selectable elements masks a non-award item.

* * * * *